United States Patent [19]

Schoeller, deceased et al.

[11] 4,013,020

[45] Mar. 22, 1977

[54] FLEXURE-COMPENSATING DEVICE FOR FLEXIBLE PALLETS SUPPORTING VERY HEAVY LOADS

[76] Inventors: Alexander Schoeller, deceased, late of Munich-Solln, Germany; by Christina von Podewils-Schoeller, heiress, CH-7524 Zuoz, Switzerland

[22] Filed: Apr. 23, 1974

[21] Appl. No.: 463,261

Related U.S. Application Data

[63] Continuation-in-part of Ser. No. 265,195, June 22, 1972, abandoned.

[52] U.S. Cl. ..... 108/51.1; 108/55.3; 108/901

[51] Int. Cl.[2] ..... B65D 19/44

[58] Field of Search ..... 108/51–58; 214/10.5 R; 248/346

[56] References Cited

UNITED STATES PATENTS

| | | | |
|---|---|---|---|
| 1,953,303 | 4/1934 | Kohlmann | 108/51 UX |
| 2,128,118 | 8/1938 | Burford | 248/346 X |
| 2,544,743 | 3/1951 | Vrabcak | 108/58 X |
| 2,906,481 | 9/1959 | Parker | 108/56 |
| 3,131,655 | 5/1964 | Sellers et al. | 108/51 |
| 3,269,336 | 8/1966 | Naylor et al. | 108/58 |
| 3,393,646 | 7/1968 | Giacobe | 108/52 |
| 3,531,855 | 10/1970 | Spring, Jr. | 108/51 X |
| 3,621,797 | 11/1971 | Hunter | 108/54 X |
| 3,645,215 | 2/1972 | Kirkpatrick | 108/51 |
| 3,698,677 | 10/1972 | Looker | 248/346 |

FOREIGN PATENTS OR APPLICATIONS

| | | | |
|---|---|---|---|
| 1,037,680 | 8/1958 | Germany | 214/10.5 R |

*Primary Examiner*—Roy D. Frazier
*Assistant Examiner*—William E. Lyddane
*Attorney, Agent, or Firm*—Depaoli & O'Brien

[57] ABSTRACT

For preventing sidewise slippage of very heavy loads being supported on the load-bearing surface of a flexible pallet, upward projections from the surface are provided. The projections are suitably sized, disposed so as to compensate for downward movement of the load-bearing surface caused by flexing of the pallet, as occurs with plastic pallets, and additionally provide lateral resistance to sidewise slippage of the load. The projections are preferably molded integrally with the surface and may be shaped as stripwise ledges and ramps, rows of isolated knobs, studs, or pyramids, for example, or serrated strips. The projections may be covered with a friction-enhancing covering, particularly if integrally molded, or may be elastomeric and capable of forming a retaining wall for the load that can be useful for a pallet loaded beyond its elastic strain limit.

1 Claim, 46 Drawing Figures

IV
III
II
E
54
58
62
30
40
32
42
18
14
64
16
20
50
52
26
28
36
38
34
56
60

II
A'
B'
C'
26
34
50
52
54
58
64
66
82
84
86
88
90
92
94
96
98

III

III
A'''
B'''
C'''
40
50
52
54
58
82
84
86
88
90
92
94
96
98
18
66

FLEXURE-COMPENSATING DEVICE FOR FLEXIBLE PALLETS SUPPORTING VERY HEAVY LOADS

CROSS-REFERENCE TO RELATED APPLICATION

This application is a continuation-in-part of copending application Ser. No. 265,195, filed June 22, 1972, now abandoned.

BACKGROUND OF THE INVENTION

1. Field of the Invention

This invention relates to pallets and especially relates to warehousing pallets used for supporting loads to be moved by lift trucks. It particularly relates to devices that prevent sidewise movement of very heavy loads on flexible pallets, such as plastic pallets.

2. Review of the Prior Art

Pallets serve as a tray-like support for the stacking and transport of articles and generally comprise lateral openings which can be engaged by the arms of fork-lift devices. Four-way pallets have these lateral openings on all four sides, and double-deck pallets have these openings between an upper deck and a lower deck. More simple constructional forms have only a single upper deck with base portions which are arranged therebeneath and between which the arms of a fork-lift truck are inserted. Box pallets essentially comprise a box-like side wall arranged around the load-supporting surface of a flat pallet.

Furthermore, it is desirable for the lateral openings of a pallet to have sufficient width and to be open towards the ground beneath the load-carrying deck of the pallet so that the arms of a fork-lift device can fit thereinto and a fork-lift truck can drive into the lateral openings and can then engage its arms underneath the pallet while having its wheels on the ground.

A feature common to all pallets is that they are intended for accommodating loads and consequently have to be constructed in a very robust and load-support manner, depending on the nature of the loads. This robustness can only be achieved with difficulty by means of metal pallets and, to a certain degree, also by means of wooden pallets; however, it is desirable to utilize substitute materials for reasons of economy, but problems arise in attempting to meet standards as to stability and permanent strength. With pallets made of plates, flexing becomes an acute problem when supporting very heavy loads.

These problems become particularly clear when considering standardized flat pallets for bottle crates, which have a standard size of 100 x 1200mm, as an example of a very heavy load. Such bottle crates may be placed in one layer, in a 3 × 3 pattern, on the corresponding load-bearing surface of such a pallet. Furthermore, it is usual for five layers of bottle crates to be stacked one above the other on the pallet.

A synthetic plastic bottle crate when empty weighs about 2 kg, and in each bottle crate there are arranged, for example, 20, 0.5-liter bottles or 24, 0.33-liter bottles. A single bottle crate with full bottles then weighs between about 18 and 22 kg, or roughly calculated 20 kg. Consequently, one layer of bottle crates weighs 180 kg and five layers weigh 900 kg, that is to say, almost 1 ton. It is consequently understandable, in view of the entirely different properties of metals and plastics as regards modulus of elasticity, tendency to non-elastic deformation, and the like, that flat pallets made of synthetic plastic materials have not yet been usable in practice for supporting bottle crates and similar heavy loads.

Suitable synthetic plastics materials for the construction of pallets are, for example, polyolefins, such as polyethylene and polypropylene, ABS polymers, and polyurethanes. However, if very heavy loads, such as coils of steel, counter rolls of paper, and bottle crates, are loaded on a flexible pallet made of such plastics, the pallet may flex or bend sufficiently to enable the load to move or slip sidewise, thereby causing all or part of the load to fall off the pallet or causing the lift truck to capsize. Obviously such slippage is potentially very dangerous and expensive.

In the prior art, a raised rim around the load-bearing surface of the pallet has hitherto been provided for stopping any lateral slipping off of the load from the pallet. However, a load may be more or less centered upon the pallet and not be close to the rim. Accordingly, a laterally moving pallet may gather considerable momentum before contacting the rim or may slide laterally sufficiently to cause severe unbalancing of the entire pallet. This effect can be particularly serious if the pallet is thereupon stressed beyond its elastic limit so that bending strain is thereafter not in proportion to stress.

This effect may also not be perceivable under static or carefully supervised operating conditions, but when fork-lift trucks are normally rushing down warehouse aisles, around corners at high speeds, and suddenly stopping at intersections, within a boxcar, etc., the momentum of the load can generate severe laterally directed forces under such accelerative and/or decelerative conditions. Consequently, a severe downward force can be created at the outward edge of the pallet (relative to the direction of the accelerative or decelerative movement) as the resultant of a couple developed from lateral momentum at the center of gravity of the load and frictional resistance at the bottom thereof. This downward force can momentarily cause extraordinarily great flexing of the plastic pallet, particularly if the elastic limit of the plastic material is exceeded; this flexing necessarily acts in combination with the momentum-derived lateral force acting on the pallet, whereby ordinarily unlikely sidewise slippage can occur.

A device is accordingly needed for improving flexible pallets so that any lateral movement of a very heavy load upon the downwardly flexed load-bearing surface thereof is prevented or is substantially inhibited before the encircling rim is contacted by the load.

SUMMARY OF THE INVENTION

It is accordingly an object of this invention to provide a flexure-compensating device which is capable of preventing any lateral movement of very heavy loads upon the load-bearing surface of a flexible pallet.

It is an additional object to provide a device having such normally vertical dimensions as to compensate for downward flexing of that portion of the load-bearing surface upon which the device is disposed.

It is another object to provide a device having a load-engaging face with a slope which inhibits lateral movement of a very heavy load over the load-bearing surface of a flexible pallet.

It is a further object to provide a device having a load-engaging face with a covering which inhibits lateral movement of a very heavy load over the load-bearing surface of a flexible pallet.

It is also an object of this invention to provide a device having deformational characteristics whereby the load-engaging surface thereof is severely deformed and the remainder thereof, in combination with an encircling rim, forms a barrier which inhibits lateral movement of a very heavy load over the load-bearing surface of a flexible pallet.

Accordingly, in satisfaction of the foregoing objects and in accordance with the spirit of this invention, a device is herein provided, in combination with the load-supporting surface of a flexible pallet, which has, alternatively or in combination, selected vertical dimensions, load-engaging faces with load-engaging slopes and slippage-resistant recovering, and/or deformational characteristics whereby a very heavy load is respectively supported in vertical alignment, with inward-directed reaction forces, with laterally resisting frictional forces, and/or with laterally resisting compressive forces.

This device comprises upwardly disposed projections on the load-bearing surface of a flexible pallet which may be in the form of normally horizontal ledges adjoined to downwardly sloping ramps, rows of isolated knobs, stubs, or pyramids, steep, closely adjacent ridges, or laterally extensive and readily deformable strips and the like. These projections are disposed along the outer margins of the load-bearing surface of a flexible pallet and selectively provided:

A. compensation vertically for the downward deformation of the pallet under a very heavy load, so that the load tends to be maintained in vertical alignment, and B. lateral resistance to sidewise slippage of the load, so that the load tends to remain in place under sidewise forces or in spite of excessive deformation because of abnormally heavy loads exceeding the elastic limit of the plastic from which the flexible pallet is constructed.

Vertical compensation is provided by ledges and inwardly declining ramps, rows of isolated knobs or stubs, knife-edged ridges and spurs, or serrated ridges which are disposed along the margins of the load-bearing surface and project upwardly to an extent that is in inverse proportion to distance from the nearest edge of the pallet.

Lateral resistance is provided by sharp edges and points, frictional coverings, inclined ramps, steeply bordered ridges, or underformed bordering portions of deformable projections. The devices of this invention all provide at least a minimum amount of vertical compensation and varying amounts of lateral resistance, the extent and proportions of these qualities being selected according to the flexing to be expected, the accelerative forces typically encountered during wardhouse handling and box-car loading thereof, and the frictional and stability characteristics of the load.

The projections can in principle be formed by different types of structures, studs, or the like. A particularly simple construction, providing simultaneous support of the load, is obtaind if the projections are made in strip-like form, such as flat-topped ledges. Furthermore, they are preferably flattened in a ramp-like manner, so that the flattened portion is still able to offer a flat support to the load, even with slight flexing of the pallet.

The projections which are provided in this sense are not to be confused with a raised rim of the load-bearing surface of the pallet, which is provided in the prior art, and which can additionally be provided with the pallet according to the invention, for stopping any slipping off laterally in the manner of a box pallet with very shortened box walls. The difference as compared with such a raised rim is seen particularly clearly from the fact that ledges provided for centering a very heavy load on the relatively rigid plastic pallet described in FIGS. 1–16 are preferably only about 2 mm higher than the central load-bearing surface of the pallet.

Preferably, these devices are integrally molded with or manufactured into the load-bearing surface of the pallet. However, it is within the purview of this invention to provide these devices in separated form as strips, for example, which may be adhesively attached to the load-bearing surface or otherwise fastened into non-slipping, load-engaging relationship therewith. Preferably, these devices, when separately manufactured, are made of extremely tough and resilient materials, such as suitable grades of polyvinyl chloride, polyurethane, polypropylene, and polyesters.

BRIEF DESCRIPTION OF THE DRAWINGS

FIG. 1 is a plan view of a multi-part pallet.

FIGS. 2 through 5 are longitudinal sections of the bearers I through IV of the pallet shown in FIG. 1.

FIG. 6 is a longitudinal section of an insert section which can be inserted in the pallet according to FIG. 1.

FIGS. 7 through 16 show on an enlarged scale and in more detailed form the section elements made of synthetic plastic which are already shown in simplified form in FIGS. 2 through 6, namely:

FIG. 7 and 8 are respectively a longitudinal section and a part sectional plan view over the half length of the bearer I according to FIG. 2;

Figures 7, 7A, 7B, 7C, 7D, 8:
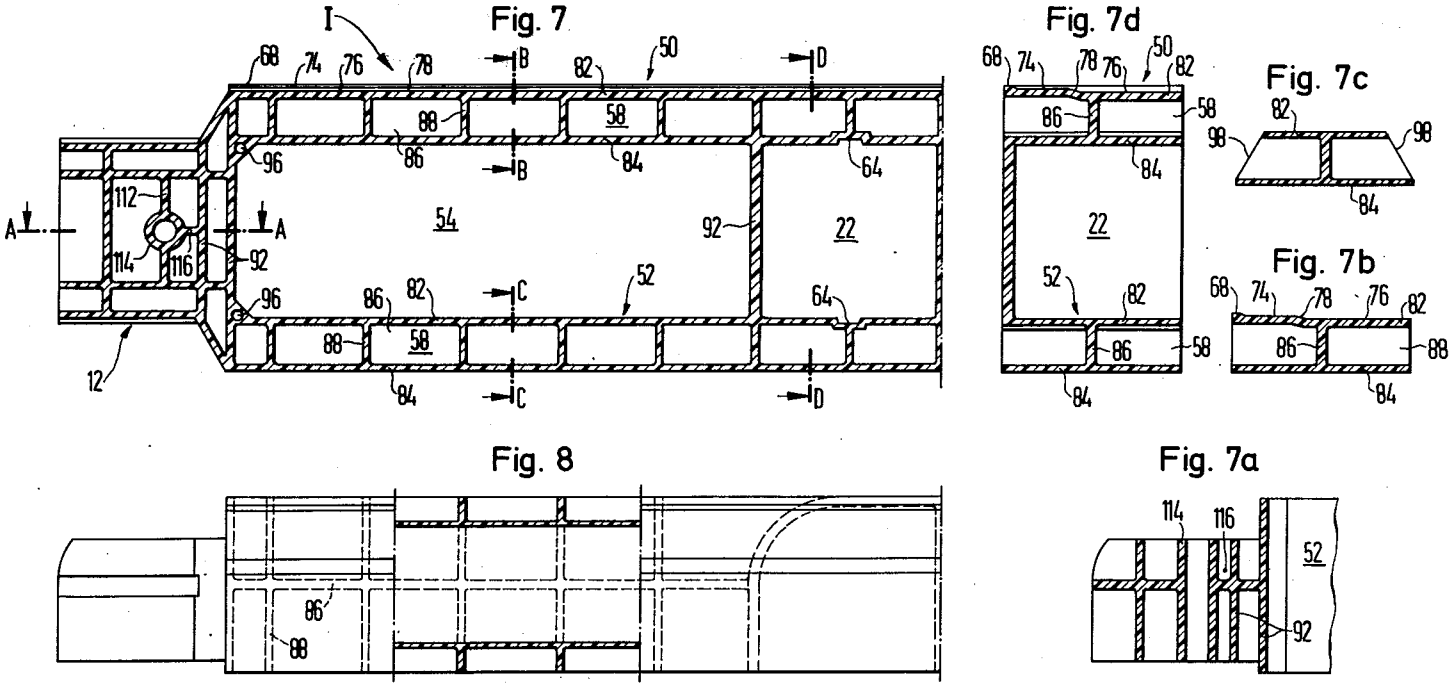

FIGS. **7*a* through 7*d* are part sections on the lines A—A, B—B, C—C, and D—D in FIG. 7;**

Figures 3, 4, 5, 6:
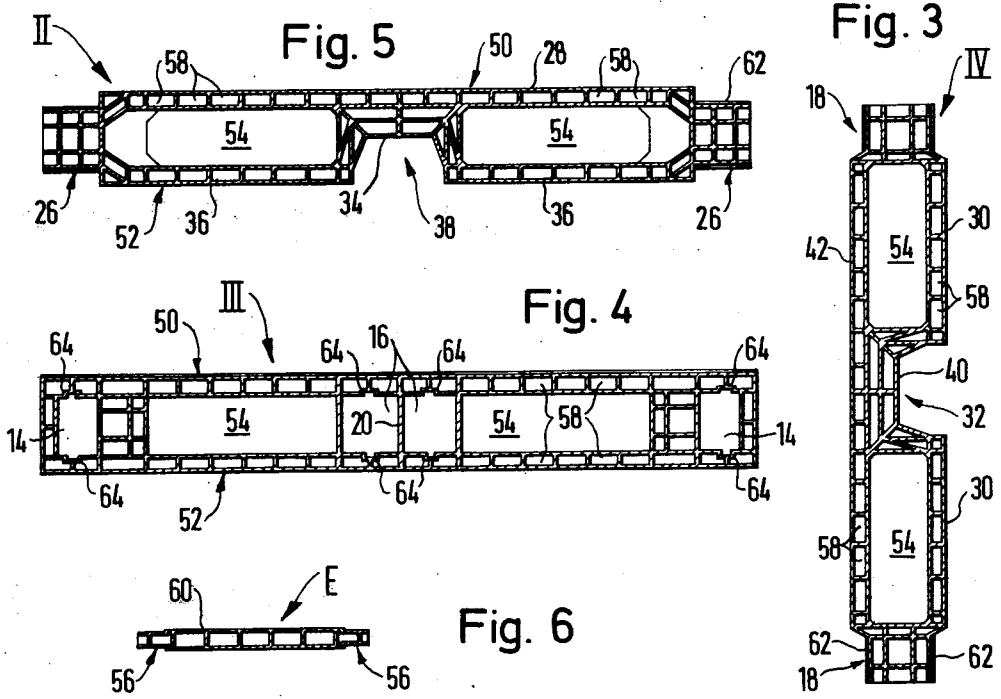
Figures 9, 9A, 9B, 9C, 10:
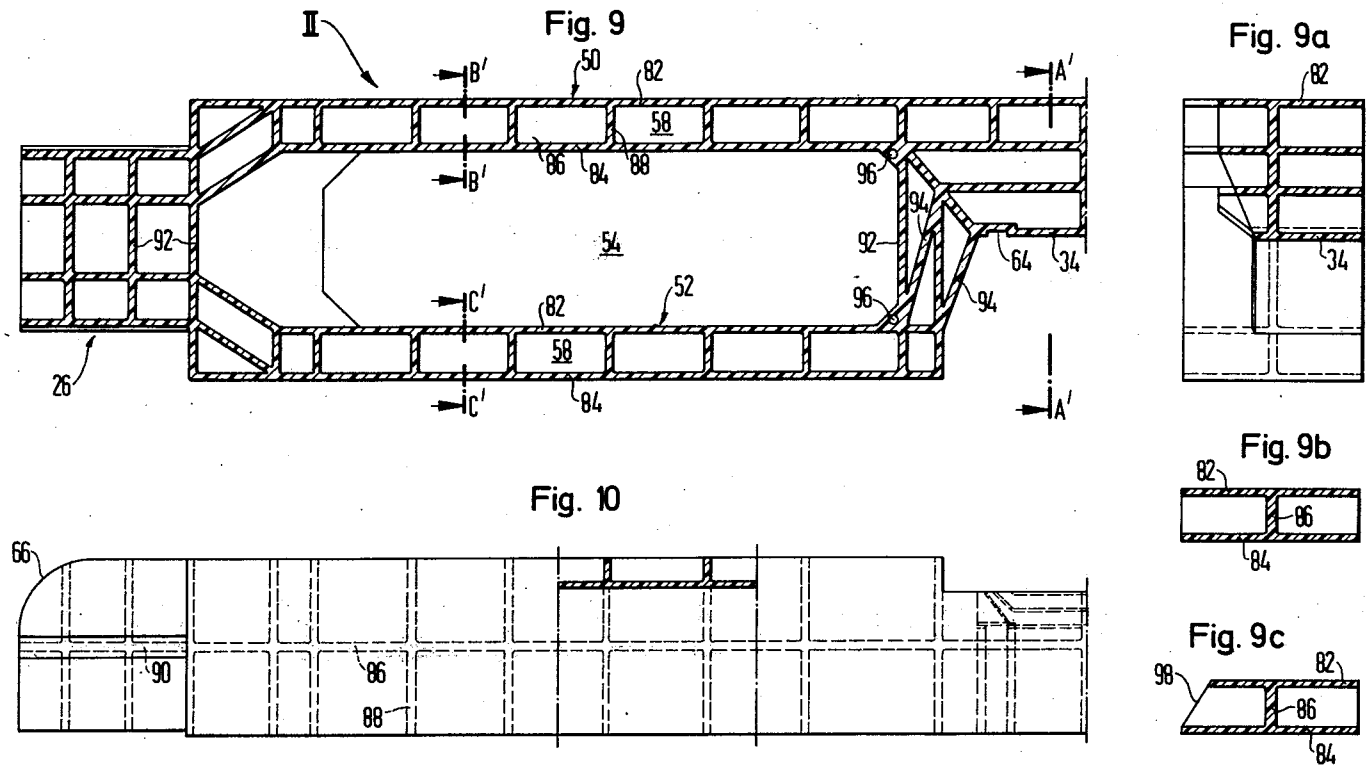

FIG. 9 and 10 are respectively a longitudinal section and a part-sectional plan view of half the length of the bearer II according to FIG. 3;

FIGS. **9*a* through 9*c* are part-sections on the lines A—A, B—B, and C—C in FIG. 9;**

Figures 11, 11A, 11B, 11C, 11D, 12:
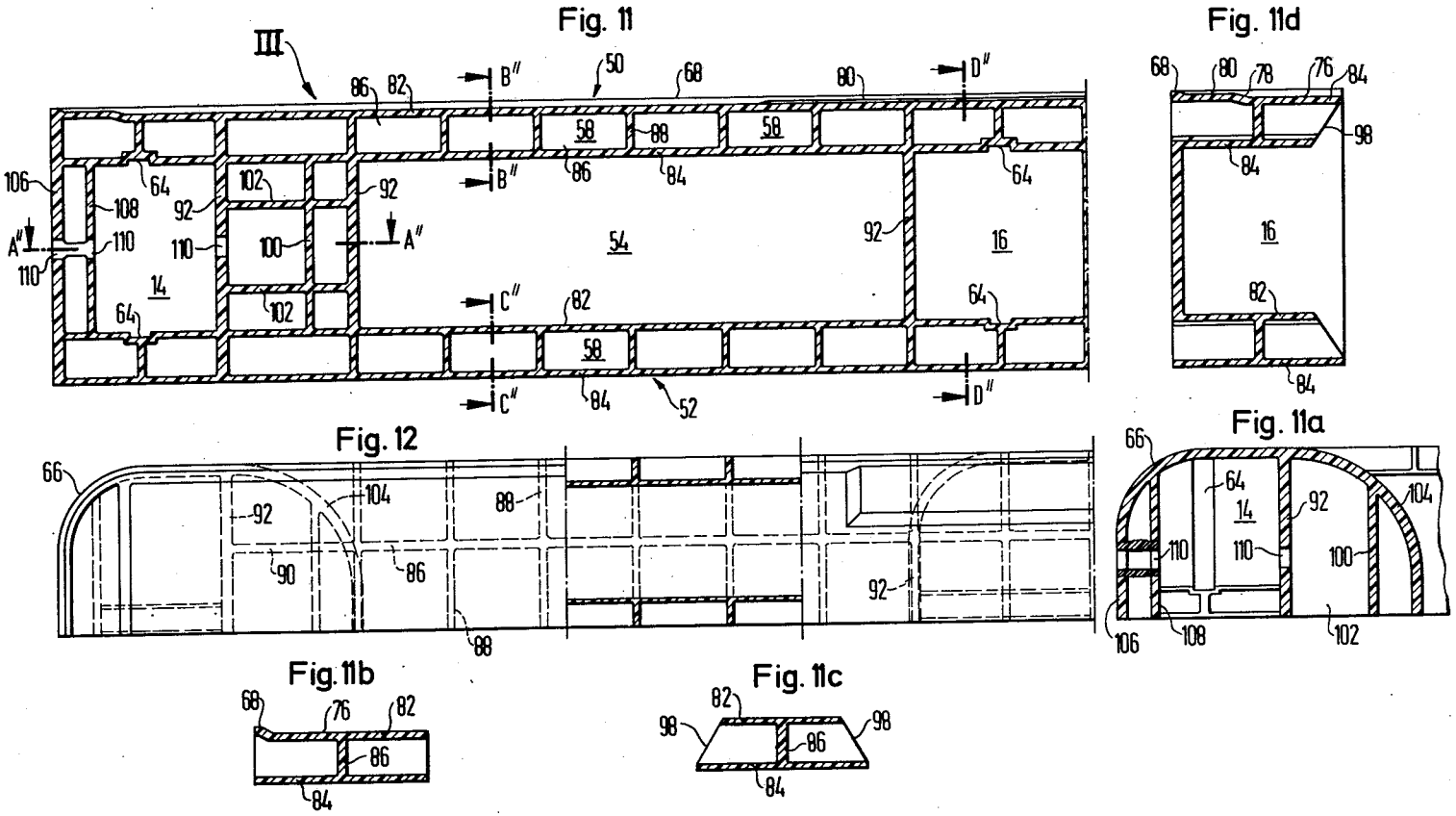

FIGS. 11 and 12 are a longitudinal section and a part-sectional plan view of half the length of the bearer III according to FIG. 4;

FIGS. **11*a* through 11*d* are part-sections on the lines A—A, B—B, C—C, and D—D in FIG. 11;**

Figures 13, 13A, 13B, 13C, 14:
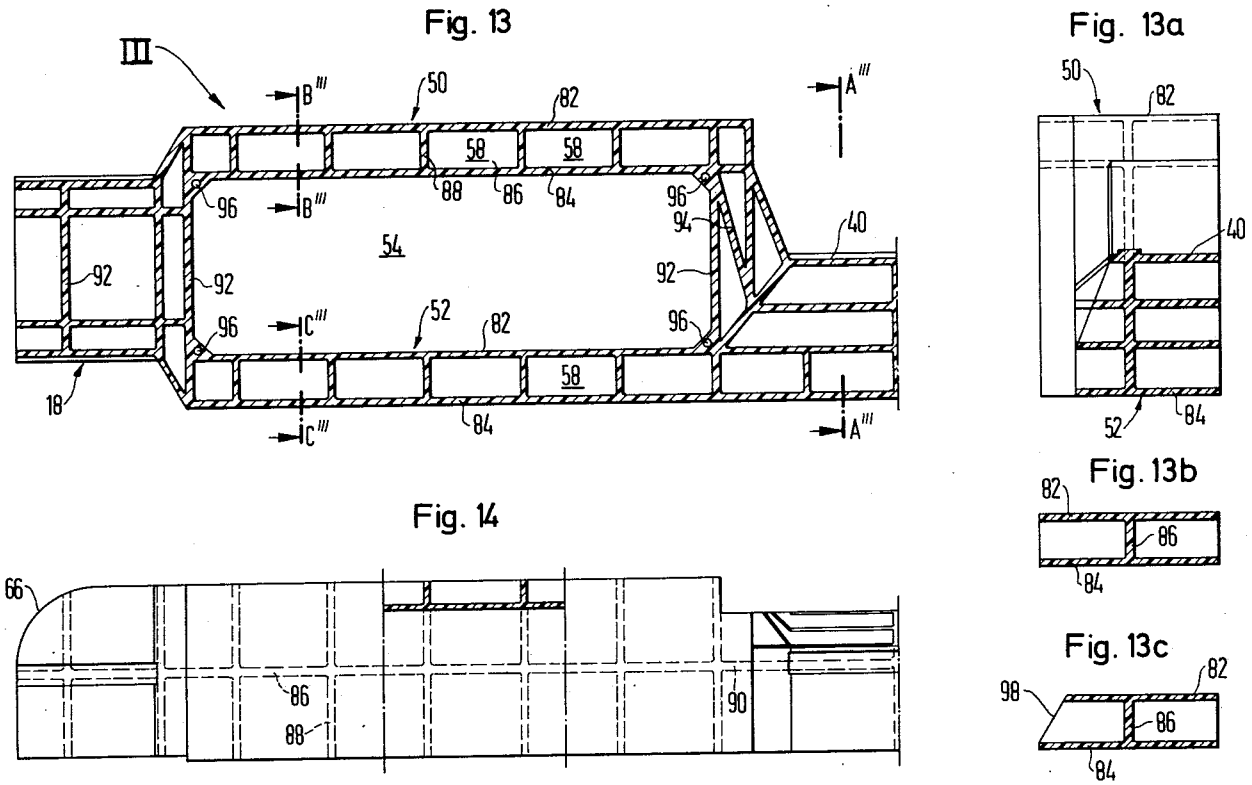

FIGS. 13 and 14 are a longitudinal section and a plan view, partly in section, of half the length of the bearer IV according to FIG. 5;

FIGS. **13*a* through 13*c* are part-sections on the lines A—A, B—B, and C—C according to FIG. 13;**

Figure 15A:
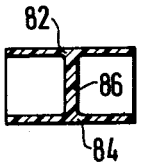
Figure 15:
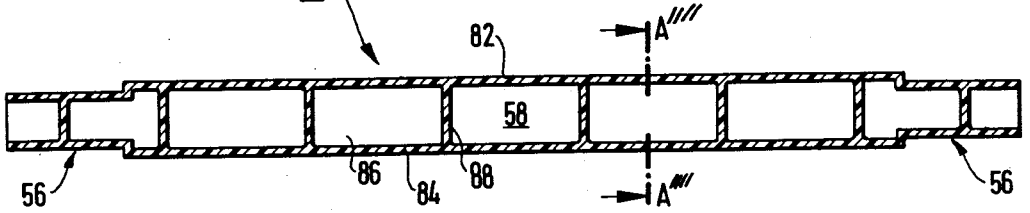
Figure 16:
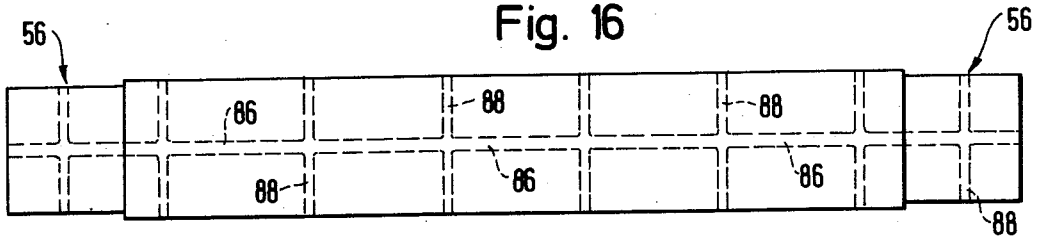

FIGS. 15 and 16 are respectively a longitudinal section and a plan view partly in section of the insert profile according to FIG. 6; and FIG. 15*a* is a cross-section on the line A—A in FIG. 15.

Figure 17:
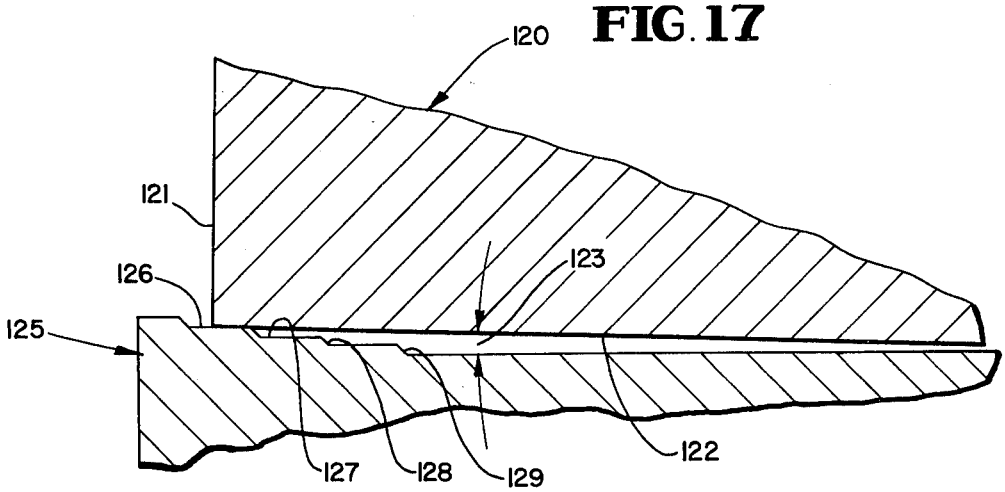
FIGS. 17–28** show other embodiments of the invention which vary as to their characteristics of vertical compensation and lateral resistance.

FIG. 17 is a detailed sectional view of a pallet, having a plurality of ledges and adjoining ramps, in supporting relationship to a load too light to flex the pallet.

Figure 18:
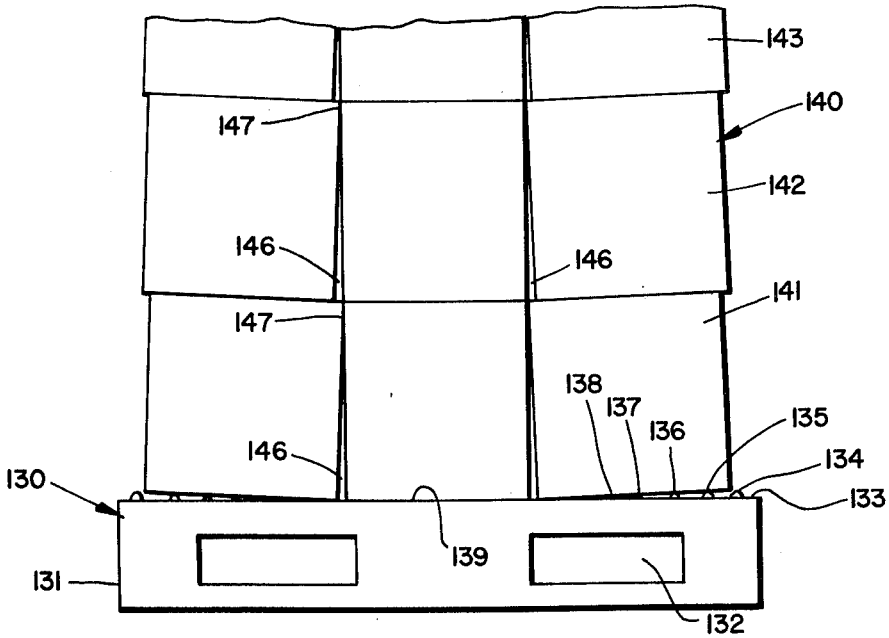

FIG. 18 is a side view of a double deck pallet having the upwardly disposed projections of this invention as a plurality of rows of knobs thereupon while supporting a light load, such as empty bottle crates in 3 × 3 layers, which is too light to cause deformation of the pallet.

Figure 19:
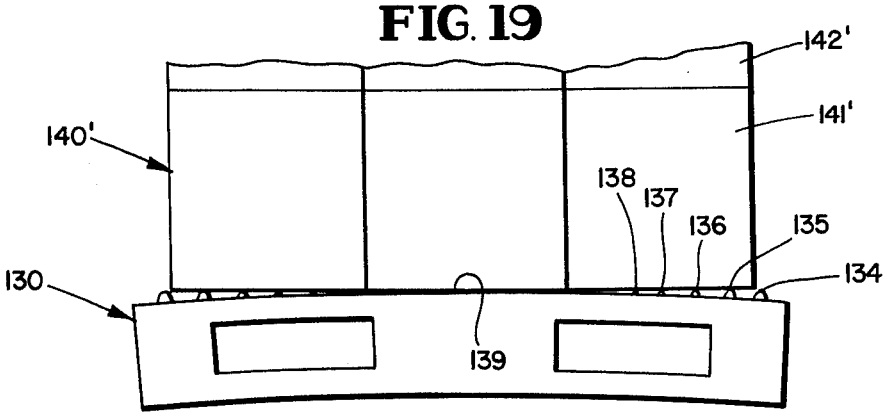

FIG. 19 is a side view of the pallet of FIG. 18 with the bottles filled to create a very heavy load which flexes the pallet.

Figure 20:
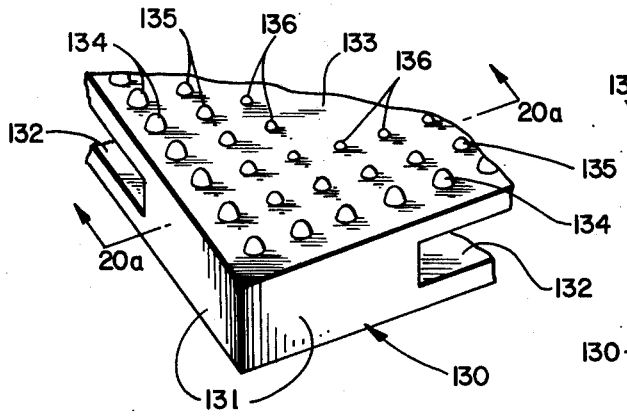

FIG. 20 is a top perspective view of one corner of a flexible double-deck pallet having a plurality of rows of upwardly projecting, isolated knobs.

Figure 20A:
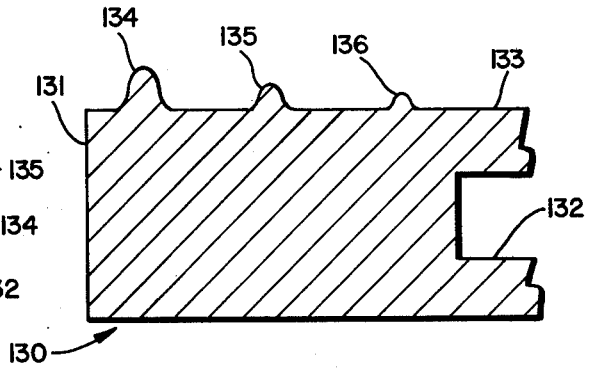

FIG. 20*a* is a sectional view in elevation of the pallet of FIG. 20, taken along the line 20*a*—20*a* in FIG. 20.

Figure 21:
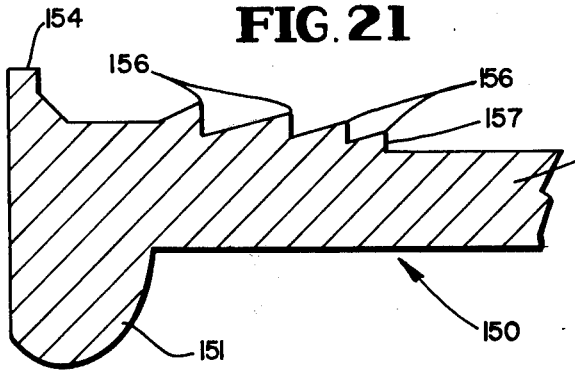

FIG. 21 is a detailed, sectional elevation view of a simple, single-deck pallet having a retaining rim therearound and a plurality of steepsided ridges in parallel to the rim.

Figure 22:
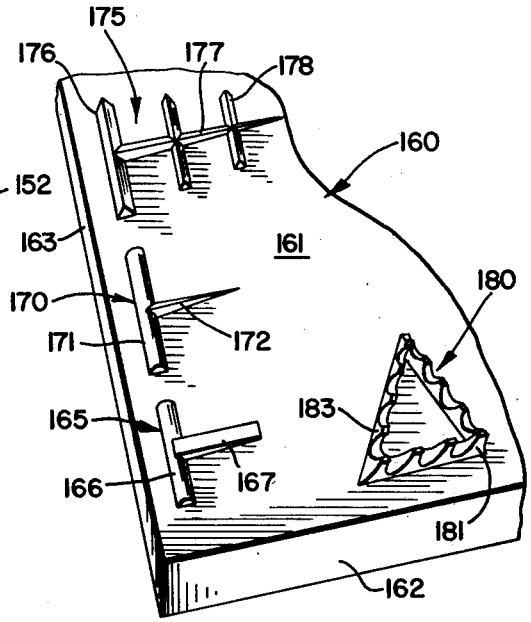

FIG. 22 is a top perspective view of a simple pallet having four exemplary embodiments of the vertically compensatory and laterally resistive device of this invention.

Figure 23:
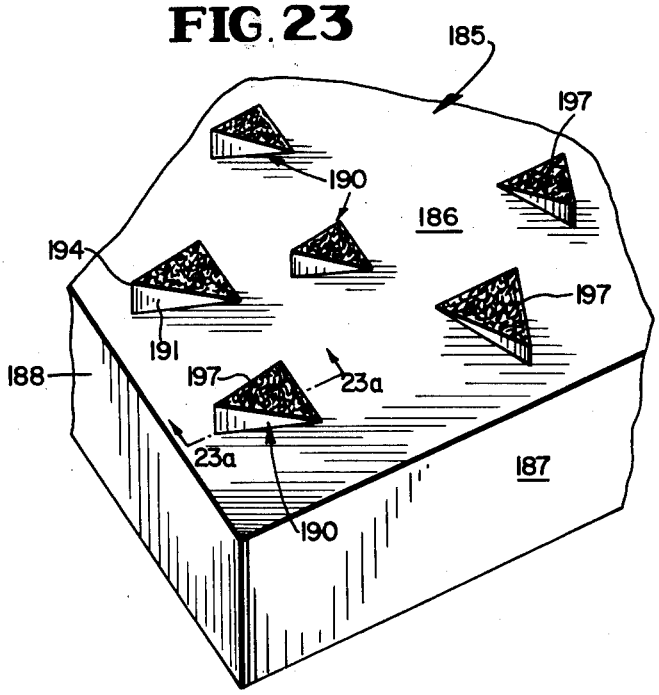

FIG. 23 is a top perspective view of one corner of a pallet having pyramidal projection having a tough frictional covering thereon.

Figure 23A:
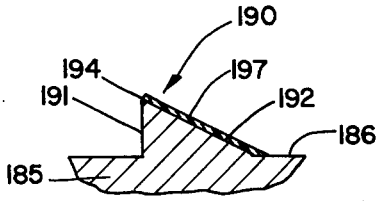

FIG. 23*a* is a sectional view of one pyramidal projection, taken along line 23*a*—23*a* in FIG. 23.

Figure 24:
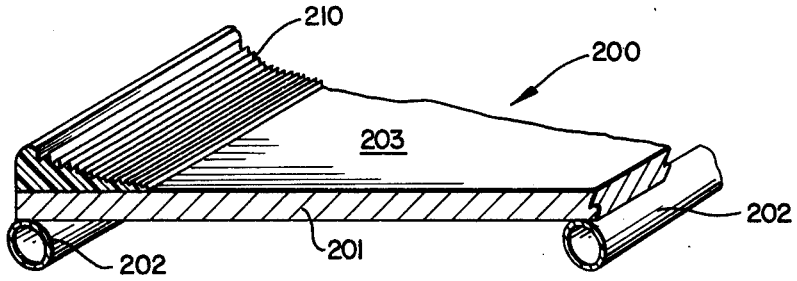

FIG. 24 is a top perspective sectional view of a single-deck pallet having the device of this invention in the form of a broad strip with a plurality of sharp-edged ridges along the inwardly declining inner side thereof.

Figure 25:
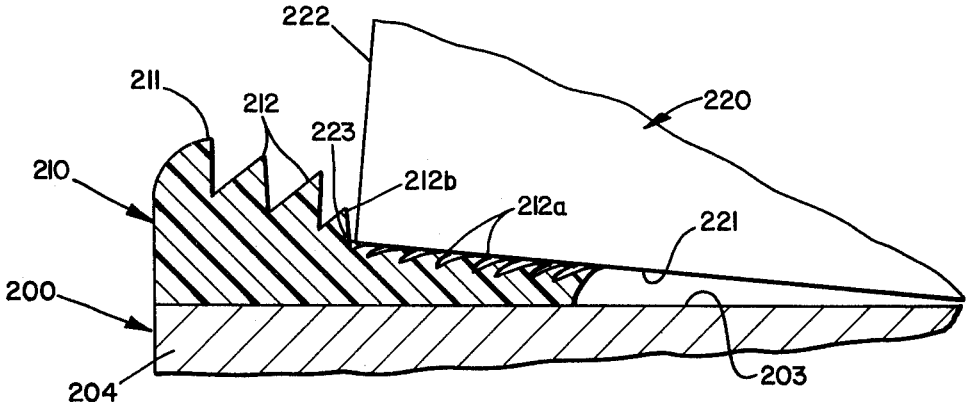

FIG. 25 is an enlarged sectional view in elevation of the pallet and broad strip of FIG. 24, the pallet being flexed slightly under a very heavy load and the strip, a relatively incompressible elastomer, being slightly deformed thereunder.

Figure 26:
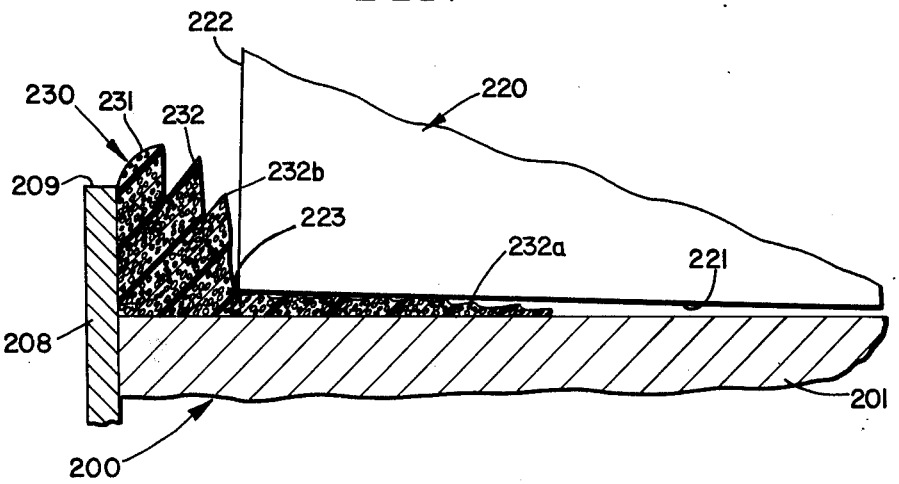

FIG. 26 is an enlarged sectional view in elevation of a very heavy load and a flexed pallet, as in FIG. 24, except that the strip is an easily compressible elastomer which is laterally supported by an encircling rim.

Figure 27:
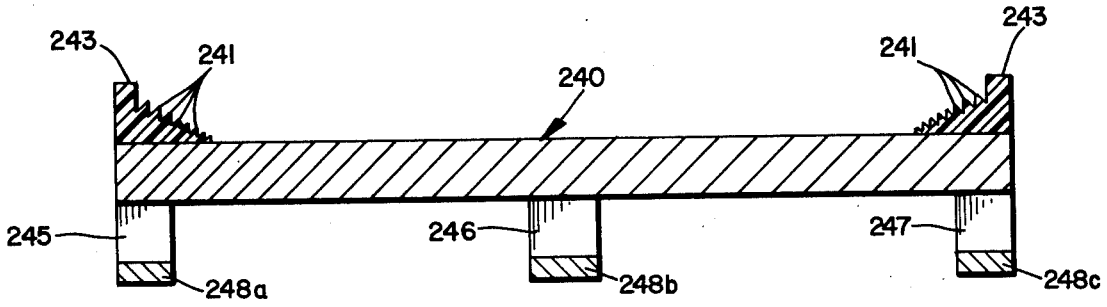

FIG. 27 is a cross-section of a pallet the upper surface of which is provided, in the marginal zones thereof, with upward projections in supporting relationship to a load too light to cause flexure of the pallet, and which is supported on bottom deck fragments by means of supporting legs.

Figure 27A:
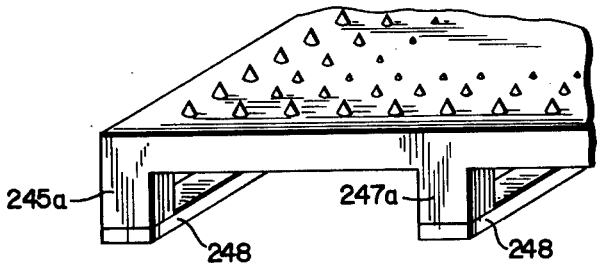

FIG. 27*a* is a top perspective view of one corner of the pallet of FIG. 27 with the bottom deck fragments being formed as sledges.

Figure 28:
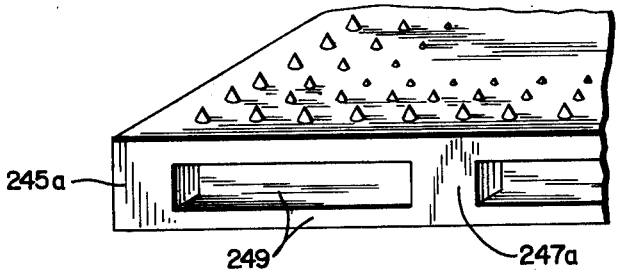

FIG. 28 is a top perspective view of one corner of a flexible pallet, having the upwardly disposed projections of this invention, wherein the top deck is connected to a continuous bottom deck by means of supporting legs.

DESCRIPTION OF THE PREFERRED EMBODIMENTS

Ledge and Ramp

For the basic structure of the pallet, four types of bearers, I through IV, are necessary in accordance with FIGS. 2 to 5. The basic structure of the pallet is supplemented by insert sections E according to FIG. 6. Both the bearers I through IV, which are used in pairs, and the insert section E are synthetic plastic profile elements prefabricated in a mold by injection molding in the form of section bars which are positively fitted together at right angles to one another into a grid forming the pallet according to FIG. 1.

Figure 2:
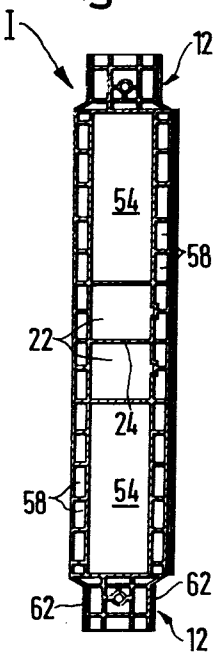
FIGS. 1–16 depict a multi-part synthetic plastic pallet of double-deck construction which is novel and exemplary of a plastic pallet having minimum deformational characteristics and adapted to construction by extrusion and combinatin of bar-type components. FIGS. **7*b*, 7*d*, and 11*d* illustrate a preferred ledge-ramp embodiment of this invention.

The pallet, indicated as a whole at 10, has a frame, the sides being formed by the pair of bearers III which face one another, the two short sides of the frame being formed by the pair of bearers I facing one another. These bearers I comprise, at each of their two ends, reduced and rounded spigot ends 12, as seen in FIGS. 2, 7*a*, and 8, which are positively inserted into corresponding insert or socket openings 14 on the two ends of the bearers III. The spigot ends 12 are set back top and bottom sufficiently in relation to the top side and bottom side of the central region of the bearer I that these top and bottom sides are in alignment with the top and bottom sides of the bearers III.

The pair of bearers III each comprise, in their middle region, two additional socket openings 16 which are arranged closely adjacent one another and symmetrically with respect to the plane bisecting the length of the bearer III, as shown in FIGS. 4, 11, and 11*d*. Spigot ends 18, which are reduced and rounded, as shown in FIGS. 3, 13, and 14, of the two bearers IV, are positively inserted into these socket openings 16, the amount of reduction top and bottom being so chosen that at least the top side of the respective bearer IV is flush with the load-bearing top sides of the frame section bars I and III. The lateral reduction of the spigot ends 18 is such that the two bearers IV bear laterally one against the other, although the spigot ends are fitted into openings 16 which are separated from one another by a partition 20.

The bearers I also comprise in their middle region two insert openings 22, as shown in FIG. 2, which are arranged closely adjacent one another, symmetrically, of the plane bisecting the length of the bearer I, but separated from one another by a partition 24. Spigot ends 26 of the two bearers II, which are reduced and rounded as seen in FIG. 10, are positively fitted into these openings 22 in the pair of bearers I. The amount of the reduction of the spigot ends 26 and the arrangement of the two bearers II in lateral juxtaposition are exactly as stated for the bearers IV.

Figure 1:
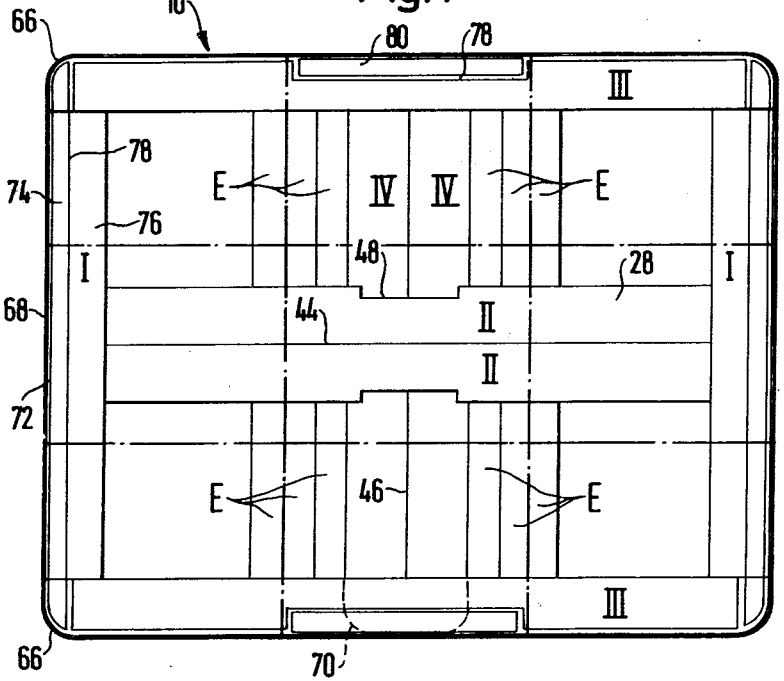

The two bearers II, arranged closely adjacent one another, and the two bearers IV, arranged closely adjacent one another, form a crossbeam with an intersection point in the center of the pallet 10, as indicated in FIG. 1. This crossbeam has the effect of a pallet grid which bridges over the rectangular frame consisting of two pairs of bearers I and III.

Whereas the spigot connections along the rim of the pallet are in each case caused by penetration of the one element into the other, by means of spigot ends 12, 18, and 26 being fitted into socket openings 14, 16, and 22, respectively, the spigot connections of the bearers II with the bearers IV at their point of intersection in the center of the pallet are obtained by the bearers II being fitted onto the bearers IV. Because of their spigot connections with the bearers III, these bearers IV also serve as a support for the bearers II.

The loadbearing top side 30 of each bearer IV is interrupted by a single central saddle-like recess 32. The two saddle-like recesses 32 of the two bearers IV are aligned with one another and serve to accommodate the two central webs 34 of the two bearers II. The central webs 34 of the latter are so set back upwardly relatively to the divided bottom side 36 of the bearer II that a central recess 38 is formed on the bottom sides of the bearers II, these recesses being arranged so as to be aligned with one another and engaging the connection web 40 of the bearer IV beneath the recess 32 thereof.

As can moreover be seen from FIG. 1, the bearers II and also the bearers IV are respectively adjacent one another in pairs along the straight, continuous, lateral surfaces 44, 46. The outer lateral surfaces of each of the bearers II do, however, have a central reduced portion 48, as seen in FIG. 1. A corresponding central reduced portion is provided on the outer lateral surfaces of each of the bearers IV, as shown at the right of FIG. 14. These central reduced portions are always somewhat shorter than the length of the saddle-shaped fittings formed by the matching recesses 32, 38 of the bearers II and IV one upon the other. Because of the positive connection created by their lateral stepping, these central reduced portions 48 assist the vertical stepping of the recesses 32, 38, in the center of the pallet, in maintaining rigidity.

The flat pallet 10 is constructed as a double-deck pallet by means of an upper deck 50 and a lower deck 52 in all section bars I through IV. These decks 50, 52 are solely connected to one another in the spigot connecting regions and have between them wide, unimpeded engagement openings 54 for the arms of forklift devices. Because these wide engagement openings 54 are provided on all four sides of the pallet 10 and extend through the bearers II and IV, the pallet 10 is a true four-way pallet.

The engagement openings 54, because of the immediately adjacent arrangement of the two bearers II and the two bearers IV, are sufficiently wide for a fork-lift truck to be able to enter on any side of the pallet. The unimpeded openings of the pallet grating between the separate bearers I and IV are also of such wide dimensions that the outwardly swivellable wheels or rollers of a fork-lift truck which has entered the pallet are able without any difficulty to contact the ground which is beneath the pallet.

On the top side of the pallet, on the contrary, such wide openings are less desirable, since they form too large a gap in the load-bearing surface of the pallet and, for example, do not guarantee a sufficient support for a layer of 3 × 3 bottle crates. For this reason, the additional insert section E according to FIG. 6 are provided. These sections E, like the bearers I through IV, are made in bar-shape form and consist of injected plastic material, but their depth of 30 mm corresponds only to the depth of the top deck 50 of the different bearers I through IV (of which the total depth is 160 mm), while their length always only makes up about a half or somewhat less of the pallet width. These insert sections E in their turn comprise reduced and rounded spigot ends 56, which are so fitted into complementary socket openings 58 on the sides of the top deck 50 of the bearers II and III according to FIG. 1 that the top sides 60 of the insert sections E lie in the plane of the load-bearing surface of the pallet.

Consequently, according to FIG. 1, always only one insert section E has to be positively inserted between the bearers I and IV in each grid opening of the pallet in order to obtain a sufficient support for the layer of 3 × 3 bottle crates. The insert sections E are made so much wider than their spigot ends 56 and such a large number of socket openings 58 are provided in the bearers II and III that, when required, the top deck of the pallet 10 can be made completely closed by means of the insert sections E. However, since the insert sections are of only a small depth, they do not interfere with the insertion of the fork-lift truck and the passage of the wheels thereof between the bearers I and IV on the bottom deck. When required, it is also possible to insert corresponding wider insert sections in the lower deck, in order to more or less close the latter. If fork-lift trucks are not to be used, it is then also possible to use insert sections which are of the same depth as the bearers I through IV.

For stiffening the pallet 10 diagonally, the spigot ends 12 and 18 also have at least one tongue 62 extending in the longitudinal direction thereof, the said tongues being formed on the top and on the bottom of the spigot ends 12 and 18. In order to provide a tongue-and-groove connection, each tongue 62 engages in a corresponding groove 64 on the top and bottom of the socket opening 14 or 16 in the bearer III, as shown in FIG. 4.

All four corners of the pallet are rouned at 66, and these rouned portions are all formed on the bearers III, as shown in FIG. 1 and 14. In addition, the pallet is provided with an encircling rim 68, as indicated in FIGS. 1, 7, *7b*, 11*b*, and 11*d*.

The spigot ends of the bearers II and IV respectively comprise a rounded portion 70 or 72 on only one side, as indicated in FIG. 1, the rounding 70 being supplemented by the rounded portions of the other bearer of the pair of identical bearers to form a complete rounding.

Any pallet made of synthetic plastic material has a certain tendency to flex under heavy loads. In order to obtain a centering of the load towards the center of the pallet, even with a bending stress on the rims of the pallet, the marginal zones of the load-bearing surface are provided with upwardly disposed projections which are so distributed according to this invention that all loads which are arranged at the edges of the load-bearing surface are given a slope towards the center of the pallet. For this purpose, a strip-like ledge 74, adjoining the rim 68 of the pallet 10, extends throughout the length of the bearer I from one edge of the pallet to the other, while extending over the full depth of the rounded portion 66 and almost over half the width of the bearer I, as shown in FIGS. 1, *7b*, and *7d*. At the transition to the load-bearing plane 76 of the pallet, there is a downwardly inclined ramp 78 as shown in FIGS. 1, *7b*, *7d*, and 11*d*. A corresponding strip-like ledge 80, indicated in FIGS. 1 and 11*d*, is provided in the middle of each of the bearers III, but this only extends over the middle third of the bearer length.

For a flat pallet to be used for bottle crates, the length of the bearers III is 1200 mm. and the length of the bearers I is 1000 mm. On a corresponding scale, both strip-like ledges 74 and 80 are merely raised about 2 mm above the load-bearing plane 76 and thus have a smaller height than the raised rim 68 of the pallet 10, the height of which is not critical in detail and can be adapted to various loading requirements.

Details of the construction of the bearers I through IV and of the insert sections E, and also of their mutual connection, are hereinafter explained by reference to FIGS. 7 through 16. In these figures, the representation of the half bearers in FIGS. 7 through 14 are to be visualized as being symmetrically supplemented.

The top deck 50 and the bottom deck 52 of all bearers I through IV, and also the single deck of the insert sections E, are respectively to be considered in their turn as being constructed in double-deck form, and in fact as so-called double-T or I-sections. These respectively comprise an upper web 82 and a lower web 84, which generally extend horizontally and in parallel relation one above the other and are connected along their center lines by a connecting web 86 joining them at right angles to form the I-section. The I-sections are in addition strengthened by transverse webs 88 on both sides and extending atright angles to the connecting web 86, these transverse webs 88 being provided at regular intervals along the I-sections, as clearly shown in FIGS. 8, 10, 12, 14, and 16.

With the bearers III disposed according to FIG. 11, the I-sections continue in alignment into the region of the socket openings 14 and 16. The bearers I, II, and IV and also the insert sections E likewise continue their I-sections into the region of the spigot ends 12, 26, and 18, as do likewise the insert sections E in the region of their spigot ends 56. As regards the bearers I, II, and IV, however, the I-sections, because of the reduction of the spigot ends, are deflected into another horizontal plane, this being done while retaining their mutual spacing within the spigot ends.

As regards the insert sections E, the mutual spacing of the webs 82 and 84 is merely shortened in the spigot ends 56. In a similar manner to that with the spigot ends, the I-sections of the bearers II and IV are further deflected at the saddle positions 34 and 40 into a horizontally offset plane, while retaining their mutual spacing in the region of the saddle positions. With all four bearers I through IV, the I-sections of the top deck 50 and of the lower deck 52, in the region of the socket openings and also in the region of the spigot ends and the saddle positions, are connected to one another by aligned extensions 90 of the connecting webs 86, as indicated in FIGS. 10, 12, and 14, and also by aligned extensions 92 of the transverse webs 88 for both decks, as indicated in FIGS. 7, 7*a*, 9, 11, 11*a* and 13.

In the regions where the deck is deflected from one horizontal plane into another, additional diagonal transverse reinforcing webs 94 are also provided as required, particularly in the region of the saddle positions of the bearers II and IV, as respectively indicated in FIGS. 9 and 13. In the region thereof and particularly at the deflecting points of the bearers I, II, and IV, lateral blind recesses 96 are also provided for avoiding accumulations of material, these recesses extending parallel to the transverse webs 88 and ending before the connecting webs 86.

As will be seen in FIG. 11, the transverse webs 88, between the upper webs 82 and the lower webs 84 of the I-section, partition the socket openings 58 into which the spigot ends 56 of the insert sections E are inserted. This partitioning, in the same way as the other partitioning of the bearers and insert sections and the arrangement of the blind holes 96, can be obtained in a simple manner with an injection molding mold which is retracted on both sides of the bearer after the molding thereof.

From FIGS. 7*b*, 7*d*, 11*b*, and 11*d*, it is also apparent that the strip-like ledges 78 and 80 and the raised rim 68 of the pallet, without reinforcing the decks of the upper webs 82 of the I-section, can be easily obtained by their corresponding displacement in an upward direction.

Furthermore, it can be seen in FIGS. 9*b*, 13*b*, and 15*a* that normally the upper web 82 and the lower web 84 are of the same width and are arranged symmetrically of the connecting web 86. Expections are, however, formed by the 30° bevellings 98 in the lower deck 52, according to FIG. 11*c* (on both sides), according to FIGS. 9*c* and 13*c* (on one side in each case), and according to FIGS. 11*d*, which serve to facilitate the introduction of a fork-lift truck above the bottom deck. The bevelling of 30° on the bottom deck is sufficient in order, for example, to allow rollers of a fork-lift truck, having a diameter of 80 mm, to run up conveniently thereupon.

Between the socket openings 14 and the fork-engaging openings 54, the bearers III, according to FIG. 11, comprise an additional reinforcing frame, which has additional vertical webs 100 and additional horizontal webs 102, as well and a continuation 104 of the outer rounding 66 into the interior, as shown in FIGS. 11*a* and 12. Furthermore, in addition to the end wall 106 of the bearer III alongside the opening 14, there is also included a double wall 108 which limits the opening 14. The other vertical limiting wall 92 of the socket openings 14, as well as the walls 106 and 108, each comprise a bore 110, these bores all being in alignment with one another along the axis of the bearer III. Moreover, the spigot ends 12 of the bearers I, according to FIG. 7, comprise an additional vertical strengthening wall 112, which is formed in its middle as a hollow cylinder 114 and is rigidly connected by a horizontal transverse strengthening wall 116 to the neighboring wall 92. When the spigot end 12 of the bearer I is inserted into the socket opening 14 of the bearer III, the bore of the hollow cylinder 114 is in alignment with the bores 110. A screwbolt (not shown) can then be inserted through all bores for securing the connection of the bearers I to the bearers III. An additional safeguard as regards the connections of the other bearers and insert sections to one another is then superfluous.

FIG. 17 illustrates a combination of a pallet 125 and a load 120 which is too light to flex the pallet 125 so that the load 120 is inwardly inclined by small angle 123 when the bottom 122 of the load contacts one of the plurality of parallel, adjoining ledges 126, 127, separated by adjoining ramps 128, 129 which incline inwardly and downwardly, thereby permitting a relatively wide latitude in location of the outlying edge 121 of the load. As may be seen from FIG. 17 and also from FIG. 24, the load-supporting surface is planar with the exception of the projections in the marginal zones.

DESCRIPTION OF THE PREFERRED EMBODIMENTS

Knobs, Ridges, and the Like

The projections of this invention, as a safety-enhancing improvement to flexible pallets supporting very heavy loads, are distributed along the marginal zones of the load-bearing surface of a flexible pallet so that all such loads which are arranged in contact with the margin of the load-bearing surface are given an inclination toward the center of the pallet. On an enlarged scale, such an inward inclination 123 caused by the projections is shown in FIG. 17.

FIGS. 18, 19, 20, and 20*a* are related. In FIG. 18, a double-deck pallet 130, having sides 131, fork-lift openings 132, a load-bearing surface 133, and rows of upwardly projecting knobs 134, 135, 136, 137, 138, which are disposed along the marginal zone of the surface 133 and increase in height with distance from the center 139, is shown in combination with a multi-tier load 140 which is too light to flex the pallet 130. Consequently, when the bottom surface 148 of the bottom most tier 141 rests upon the row of knobs 135, as the highest knobs encountered, the crates in the tiers 141, 142, 143 are tilted towards the center 139 of the load-bearing surface 133 so that their tops 147 touch and their bottoms are separated by the space 146, thereby clearly contributing to stability of the load 140.

In FIG. 19, the light load 140 is replaced with the very heavy load 140' which flexes the pallet 130 so that its center 139 supports the central crate of the bottom tier 141' and the outlying crates rest in substantially vertical alignment upon several rows of knobs 135, 136, 137, 138.

Three rows of knobs, 134, 135, 136 are shown in FIGS. 20 and 20*a* as an integrally molded part of the load-bearing surface 133 and are disposed sidewardly (i.e., in parallel to the nearest side of the pallet) but decline in height inwardly (i.e., the height of each row clearly decreases in inverse relationship to distance from the nearest edge 131) so that any anticipated flex of the pallet 130 would nevertheless at least maintain the load in substantially vertical alignment. In addition, because the knobs tend to penetrate the bottom surface of a very heavy load to some extent, they provide some lateral resistance to sidewise movement of the load.

A simple, single-deck integrally molded pallet 150, having a foot section 151, upstanding rim 154, and a deck 152, comprises a plurality of sharp-edged ridges 156 with steep sides 157 facing toward the center of the pallet. The ridges 156 are disposed sidewardly and descend in height inwardly to meet the load-engaging surface 153. This embodiment of the flexure-compensating device is simple to manufacture and furnishes a high degree of lateral resistance because one of the steep sides 157 becomes squarely opposed to a side of a load whenever it tends to move sidewardly.

An illustrative melange of strips, studs, and ramps is depicted in FIG. 22 on a simple pallet 160 having sides 162, 163, and a load-bearing surface 161. Compensatory device 165 comprises a half-round strip 166 which is disposed in parallel to the nearest edge 163 and is perpendicularly attached to a flat-topped ramp 167.

Compensatory device 170 comprises a half-round strip 171 which is perpendicularly attached to a triangularly shaped and inwardly disposed ramp 172. Compensatory device 175 comprises a triangularly shaped strip 176, disposed sidewardly to provide lateral resistance to a very heavy load, which is perpendicularly attached to a triangularly shaped ramp 177 having two smaller strips 178 perpendicularly disposed thereto and spaced apart.

Compensatory device 180 comprises rows of specially shaped studs in a triangular shape and with diminishing height toward one corner thereof, the sidewardly disposed strip of studs 181 being of uniform height, and the attached strips 182, 183 converging and diminishing in height with inward distance to form a toothed, ramp-like load-engaging and flexure-compensating device.

The pyramidal compensatory devices 190 shown in FIGS. 23 and 23*a* on pallet 185, having sides 186, 187 and load-engaging surface 188, are disposed sidewardly in rows and diminish in size with inward distance. Each pyramidal projection 190 has steep sides 191, a ramp-like face 192, and a top point 194. A tough, high-friction covering 197 covers the face 192. The relationship of height (from surface 186 to top point 194) to inward distance along face 192 is, of course, exaggerated. The slope of a face 192 should be at least sufficient compensate for flexing of the pallet 185 under a very heavy load and preferably somewhat greater so that lateral movement thereover is slightly uphill even after flexure.

FIGS. 24, 25, and 26 are related. A relatively broad strip 210, with sharp ridges on the inner side thereof which decline in height in proportion to distance from the pallet side 204, is attached, as with adhesives, to the load-engaging surface 203 of the simple pallet 200 having tubular feet 202 and bed 201. The strip 210 is attached in the marginal zone of the surface 203 and can function as a rim if tough enough to withstand lateral stresses. The strip 210 may be made of a relatively rigid plastic, a high-durometer elastomer as shown in FIG. 25, or an easily compressible elastomer as shown in FIG. 26.

A very heavy load 220, having a bottom surface 221 and a side 222, slightly depresses some of the ridges 212*a* as its bottom edge 223 deforms the farthest outlying ridge 212*b* which is contacted, and downwardly flexes the pallet 200. The remaining ridges 212 and the border ridge 211 then form a laterally resistive border or rim to sidewise movement of the load 220.

The highly elastomeric strip 230, shown in FIG. 26, is similarly attached to the surface 203 and to the pallet rim 208. Where the edge 222 of the very heavy load 220 contacts the strip 230, the nearest ridge 232*b* is deformed and more centrally located ridges 232*a* are more drastically compressed, but the flexure suffered by the pallet 200 is nonetheless compensated for by the compressed thickness of the ridges 232*a*. The remaining ridges 232 and the border ridge 231 can be compensated against the rim 208 by lateral movement of the load 220, but sufficient energy is thereby absorbed that the device 230, in combination with the rim 208, offers considerable lateral resistance.

FIGS. 27, 27*a* and 28 are related. The top deck 240 of the plastic pallet is provided with projections 241, 242 in the marginal zones thereof and additionally with an encircling rim 243, while the remaining load-supporting upper surface 244 is planar, as may be seen in FIG. 27. The top deck 240 is provided with supporting legs 245, 246, 247 which may differ in number and shape. For instance, the four corners of the pallet may each be provided with a supporting leg 245*a* such as shown in FIGS. 27*a* and 28, a supporting leg (FIG. 27) in the center of the load-supporting surface 244, and one or more intermediate leg(s) 247*a* each (FIGS. 27*a* and 28) at the pallet edge between two respective corner legs 245*a*. As shown in FIG. 27, bottom deck fragments 248*a*, 248*b*, 248*c* are disposed at the bottom portions of supporting legs 245, 246, 247. In the embodiment shown in FIG. 27*a* these bottom deck fragments are designed as sledges 248.

FIG. 28 now shows a sectional view of the pallet wherein the pallet does not show bottom deck fragments at its supporting legs 245*a*, 247*a*, but a continuous bottom deck 249.

The flexure compensating device of this invention for a flexible pallet under a very heavy load is accordingly selectively variable in deformability but is designed to provide sufficient tilting, whether deformed by the load or if essentially nondeformable, that the load is at least maintained in vertical alignment as shown in FIG. 18, even when the pallet is subject to momentarily excessive stress causing non-elastic strain thereof, and preferably always projects high enough above the load-engaging surface of the pallet to impart a slight inward tilting of the load at all times. In addition, the load-engaging shape and frictional characteristics of the device are designed to provide sufficient lateral resistance that sidewise slippage is inhibited, even in the presence of extraordinary accelerative or decelerative forces.

Various alterations, changes, and modifications of this flexure compensating, device from the embodiments hereinbefore described are clearly feasible to those skilled in the art without departing from the true spirit and scope thereof, but the invention is to be construed only according to the following claims when broadly construed.

What is claimed is;

1. A flexure compensating device for a flexible pallet supporting a very heavy load and having a load-supporting surface with marginal zones thereon, comprising projections providing both vertical compensation for downward deformation of said pallet and lateral resistance to sidewise movement of said heavy load, said projections being:

A. disposed along said marginal zones and tending to cause tilting of said load toward the center of said pallet in absence of said downward deformation and substantially vertical alignment in presence of said downward deformation of said pallet; and B. in the form of a plurality of sidewardly disposed ledges and edge-adjoined ramps which:

1. incline inwardly and downwardly to meet said load-supporting surface; and 2. are parallel and adjoining in each of said marginal zones, said ramps having a sufficiently steep slope that each of said ramps can engage an outward edge of said very heavy load and offer lateral resistance to sidewise sliding of said load, at least partially by forcing said outward edge to move uphill during said downward deformation.

* * * * *

UNITED STATES PATENT OFFICE

CERTIFICATE OF CORRECTION

Patent No. 4,013,020 Dated March 22, 1977

Inventor(s) Alexander Schoeller

It is certified that error appears in the above-identified patent and that said Letters Patent are hereby corrected as shown below:

In line 52 of column 1, cancel "100 x 1200mm" and substitute --1000mm x 1200mm--.

Signed and Sealed this

Sixth Day of December 1977

[SEAL]

*Attest:*

RUTH C. MASON
*Attesting Officer*

LUTRELLE F. PARKER
*Acting Commissioner of Patents and Trademarks*